US005509720A

United States Patent [19]

Croom

[11] Patent Number: 5,509,720

[45] Date of Patent: Apr. 23, 1996

[54] ALPHABET BLOCK CHAIR KIT

[76] Inventor: Dorothy J. Croom, 15 Cedar Hill Dr., Durham, N.C. 27713

[21] Appl. No.: 311,173

[22] Filed: Sep. 23, 1994

[51] Int. Cl.[6] ..... A47C 7/00

[52] U.S. Cl. ..... 297/440.14; 297/440.16; 297/181; 446/482; 446/127; D6/358

[58] Field of Search ..... 297/440.14, 440.1, 297/DIG. 2, 181, 440.15, 440.16; D6/358, 334, 351, 368, 345; 40/320; 446/482, 127

[56] References Cited

U.S. PATENT DOCUMENTS

| | | | |
|---|---|---|---|
| D. 224,634 | 8/1972 | Kohl | D6/358 |
| D. 243,896 | 4/1977 | Zapf | D6/334 |
| D. 288,151 | 2/1987 | Lindstrom | D6/358 |
| D. 335,224 | 5/1993 | Freeman et al. | D6/345 X |
| 1,531,542 | 3/1925 | Cogshall | 446/127 X |
| 2,565,823 | 8/1951 | Pool | 446/127 |
| 3,944,282 | 3/1976 | Nakamura | 297/440.14 |
| 4,077,517 | 3/1978 | Hilemn | 297/440.1 X |
| 4,695,092 | 9/1987 | Hittie | 297/181 X |
| 5,069,647 | 12/1991 | Zuviria | 446/127 |
| 5,356,204 | 10/1994 | McDonough | 297/181 X |

FOREIGN PATENT DOCUMENTS

| | | | |
|---|---|---|---|
| 132185 | 1/1985 | European Pat. Off. | 297/440.1 |
| 558599 | 5/1923 | France | 40/320 |

*Primary Examiner*—Milton Nelson, Jr.
*Attorney, Agent, or Firm*—Rhodes, Coats & Bennett

[57] ABSTRACT

An alphabet block kit comprising a series of blocks that have letters of the alphabet inscribed or formed on the faces thereof and wherein the respective blocks can be assembled to form a chair and further can be readily disassembled.

7 Claims, 3 Drawing Sheets

ALPHABET BLOCK CHAIR KIT

FIELD OF INVENTION

The present invention relates to toys and toy kits and more particularly to an alphabet block toy chair kit.

BACKGROUND OF THE INVENTION

It is well-known and appreciated that children enjoy playing with block-type toys and particularly enjoy the challenge of forming blocks into various structures and configurations. Also, it is appreciated that children learn from block-type toy structures especially alphabet-type blocks.

Therefore, there has been and continues to be a need for block-type toys or block-type toy kits that endeavor to teach and educate young children and present a formidable challenge insofar as forming the blocks into a structure.

SUMMARY AND OBJECTS OF THE INVENTION

The present invention presents an alphabet block chair kit that is designed to teach and educate the letters of the alphabet to children and which are particularly designed to be assembled into a chair-type structure. Moreover, the alphabet block chair kit of the present invention is designed such that children can easily disassemble the blocks and play with the blocks individually as well as in groups.

The kit of the present invention includes a series of blocks with each block having a plurality of faces and formed on respective faces of each block is a letter of the alphabet. In the case of the present disclosure, the kit is designed such that respective blocks can be fastened or secured together to form a chair structure which can actually be used by the child.

It is therefore an object of the present invention to provide an alphabet block chair kit that teaches children playing with the kit the letters of the alphabet and wherein the blocks comprising the kit are designed to be fastened together to form an actual chair structure that can be occupied by the child.

A further object of the present invention resides in the provision of an alphabet chair kit that is safe and wherein the individual blocks comprising the same are constructed of a lightweight material such that the respective blocks forming the kit can be easily handled and manipulated by children.

Still a further object of the present invention is to provide an alphabet block chair kit of the character referred to above that includes means for securely fastening the individual blocks together in such a fashion that the blocks will not inadvertently be separated.

It is also an object of the present invention to provide an alphabet chair kit of the present invention that is designed in such a fashion that the individual blocks comprising the kit will exhibit or display all or substantially all of the letters of the alphabet.

Another object of the present invention is to provide an alphabet chair kit wherein the individual blocks comprising the kit can be oriented in numerous positions in the assembled chair such that more than one letter of certain blocks can be exposed while that block forms a part of an assembled chair.

Another object of the present invention resides in the provision of an alphabet block chair kit that is designed to present at least some challenge to the child playing with the kit while at the same time not presenting such a difficult task as to frustrate and discourage the child from playing with the alphabet chair kit.

Other objects and advantages of the present invention will become apparent and obvious from a study of the following description and the accompanying drawings which are merely illustrative of such invention.

DETAILED DESCRIPTION OF THE INVENTION

Figure 1:
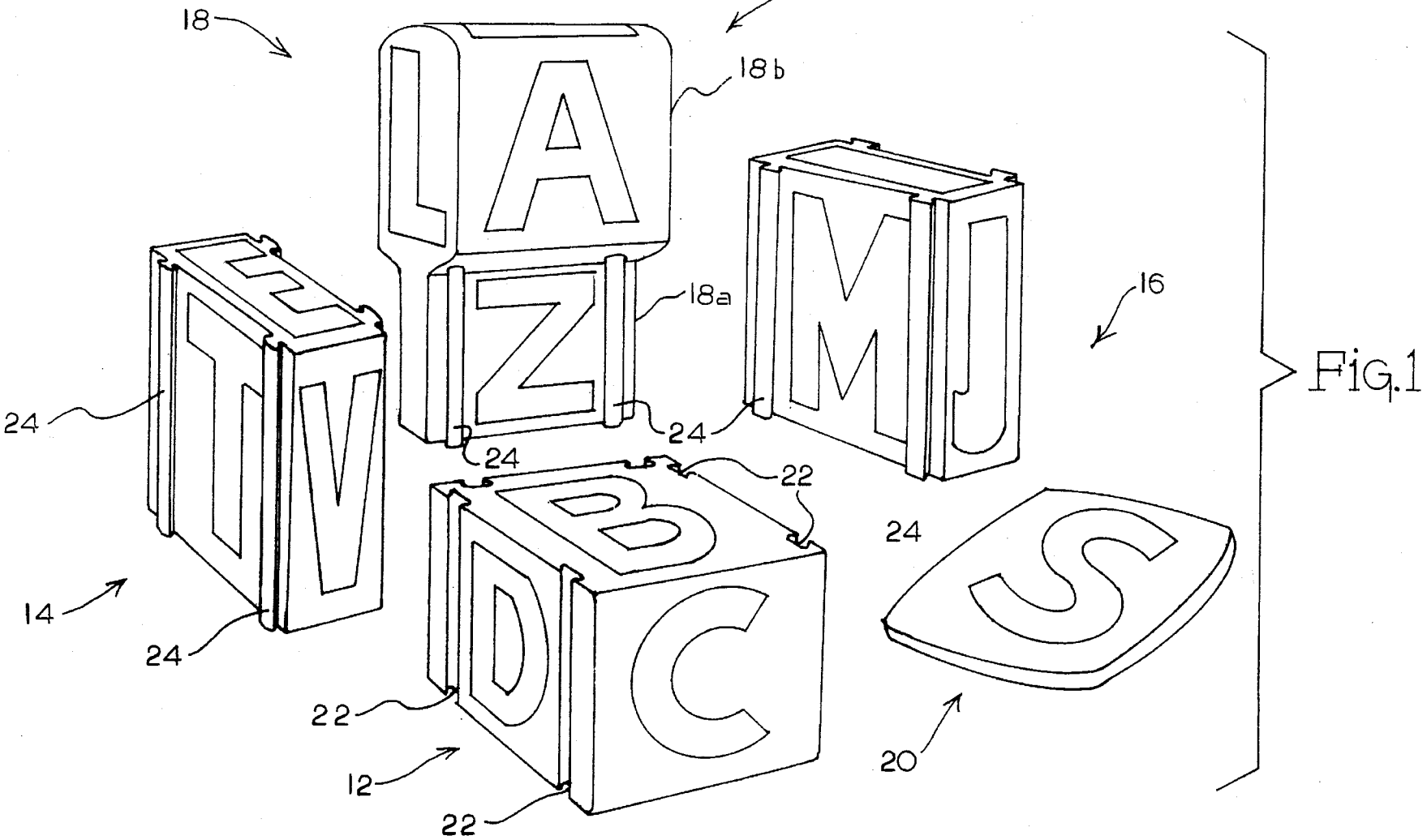
FIG 1 is a perspective view of the various blocks and cushion accessory that forms the alphabet block chair kit of the present invention.

With further reference to the drawings, the alphabet block chair kit of the present invention is shown therein and indicated generally by the numeral 10. Viewing the alphabet block chair kit 10 in more detail, it is seen that in the design or embodiment illustrated in the drawings that the same comprises four individual blocks, a seat block indicated generally by the numeral 12, two arm blocks indicated generally by the numerals 14 and 16, and a back block indicated generally by the numeral 18. Note that back block 18 assumes a generally T-shape block in that it includes a relatively thin lower section 18a and a relatively thick upper section 18*b*. This allows the upper section to extend over a portion of the top of the seat block 12 and thereby provides additional stability when the blocks are secured together to form the assembled chair of FIG. 2. It will be appreciated, however, that the alphabet block chair kit 10 of the present invention may include more or less blocks than that shown in the drawings depending on the design of the total kit. Also forming a part of the chair kit 10 of the present invention is a cushion indicated generally by the numeral 20.

Each of the blocks that form the alphabet block chair kit 10 of the present invention include a plurality of sides or faces. All of the blocks include at least six faces while the back block 18 includes eight sides or faces including the top and bottom. With the exception of the bottom of back block 18, all sides of the respective blocks have one letter of the alphabet formed thereon. For example, as seen in FIG. 1, the seat block 12 includes the letters "B", "D", and "C" on the three faces exposed in FIG. 1. In like manner, the arm block 14 shown in FIG. 1 includes the letters "T", "E", and "V" on the faces exposed therein. Again, it is appreciated that the unexposed faces of these blocks would also include other letters of the alphabet.

The present invention contemplates that all letters of the alphabet will form a part of the total kit 10. Twenty-five of the twenty-six letters of the alphabet are formed on the four blocks 12, 14, 16, and 18 shown in FIG. 1. It will be noted that all faces of the respective four blocks include a letter of the alphabet except for the bottom of back block 18. This is because the bottom side or face of the back block 18 as oriented in FIGS. 1 and 2, will always face the floor or other support surface and therefore in an assembled mode, would not be exposed.

Figure 2:
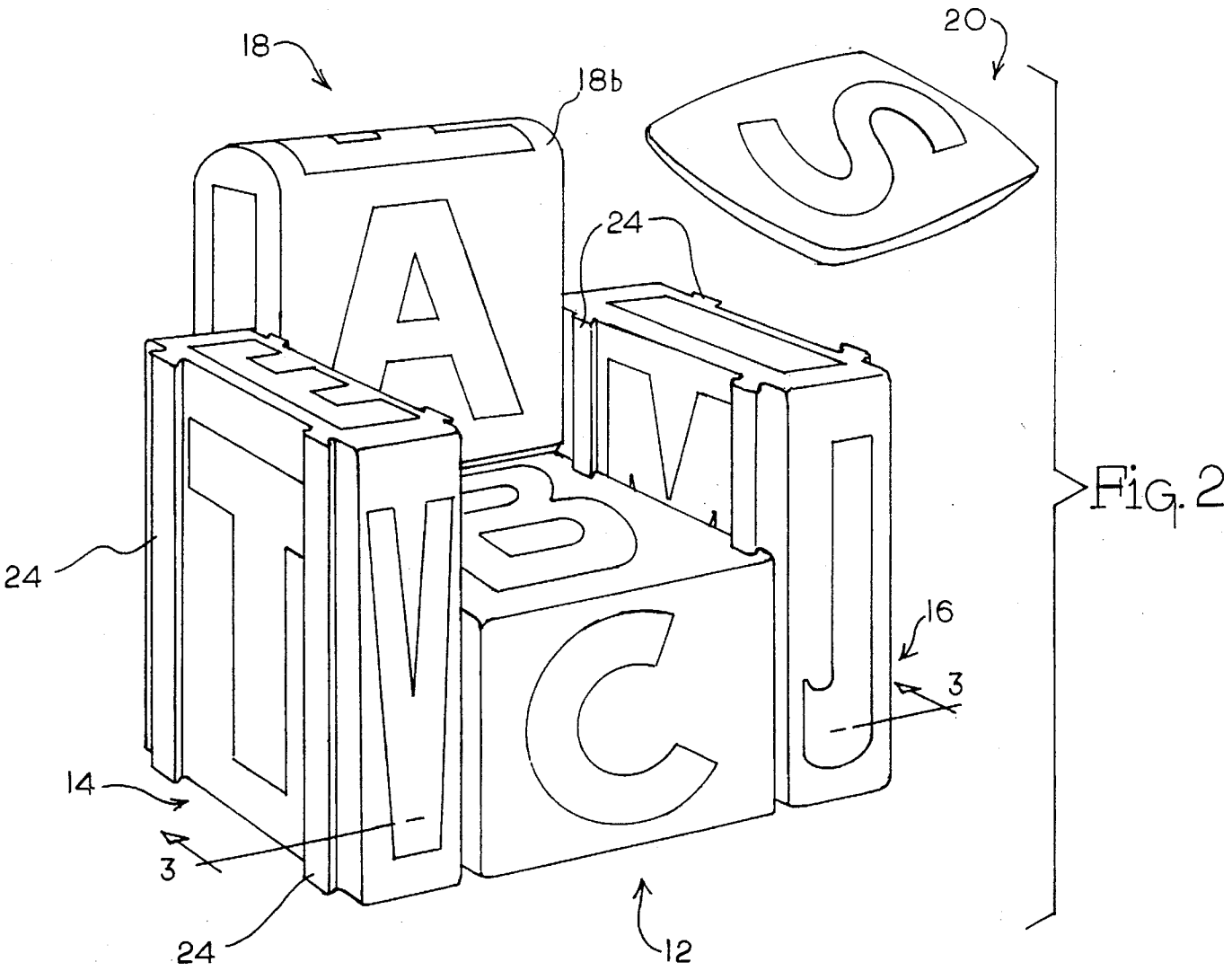
FIG. 2 is a perspective view of the alphabet chair kit of the present invention showing the respective blocks of the kit assembled into a chair.
Figure 3:
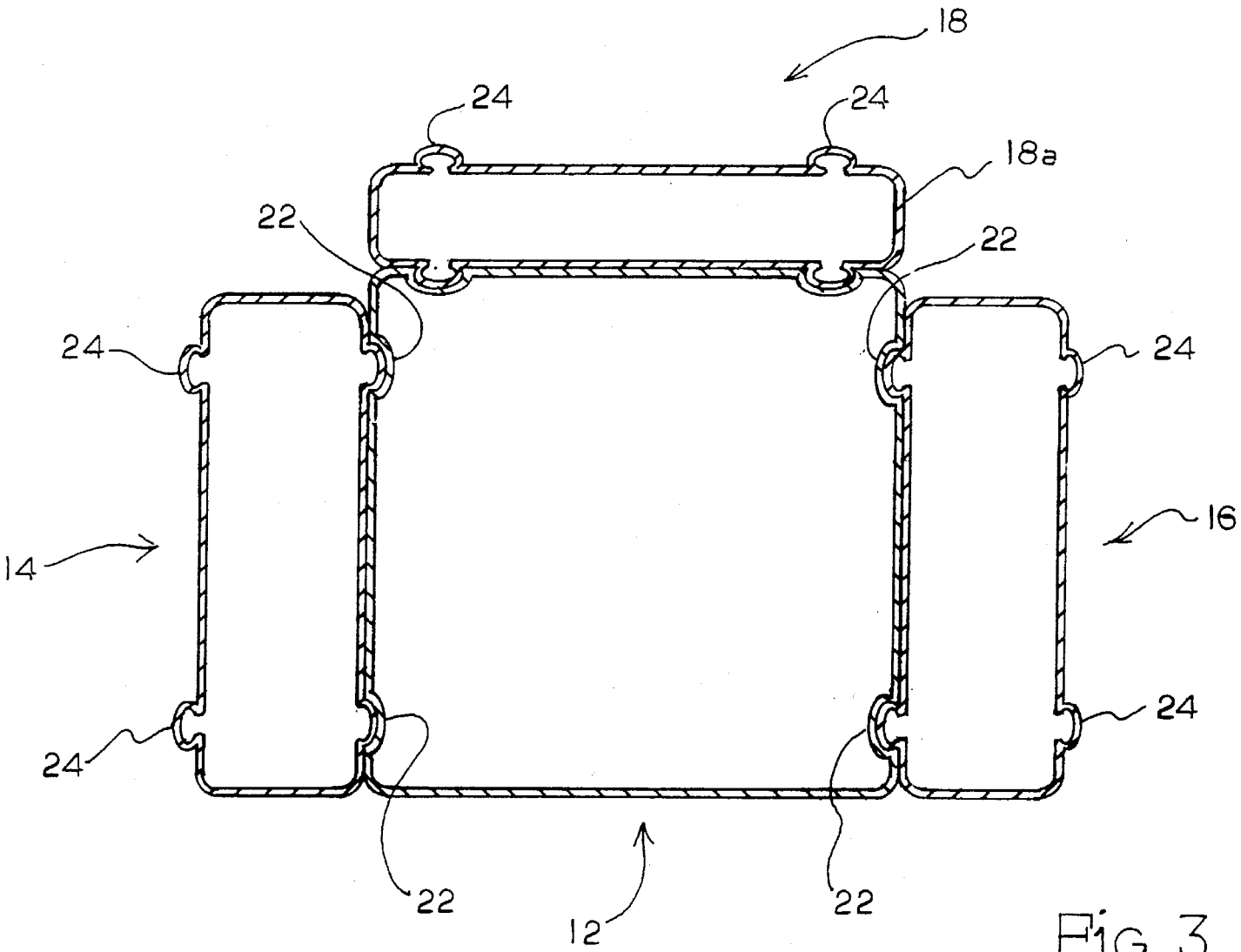
FIG. 3 is a horizontal cross-sectional view of the assembled chair shown in FIG. 2.

The alphabet block chair kit 10 of the present invention is designed such that the individual blocks 12, 14, 16 and 18 can be detachably secured so as to form the chair shown in FIG. 2. Accordingly, the respective blocks are provided with cooperative fasteners for securing the plurality of blocks together to form the chair. To achieve this, the respective blocks are provided with elongated slots 22 and elongated mating locking rails 24 for securing the blocks together. In particular, as shown in FIG. 1, it is seen that the seat block 12 includes a pair of vertical elongated slots 22 formed on opposite sides of the block and on a back side. In particular, the seat block 12 is provided with six elongated slots 22. Each elongated slot, as shown in FIG. 3, is of a generally C-shape and cross-section. The C-shaped cross-section of the elongated slots 22 is designed to accept the individual mating and locking rails 24 which are also generally C-shaped.

It is appreciated that the elongated mating rails 24 are formed on certain faces or sides of the arm blocks 14 and 16 as well as the back block 18. Note in particular that both arm blocks 14 and 16 include a pair of mating locking rails 24 on opposite sides thereof. Likewise, note in FIG. 3 that the lower opposed faces of the back block 18 also include elongated mating locking rails 24. It is understood that the locking rails 24 associated with the back block 18 are formed on opposed lower sides of the block such that the same can be reversed with respect to the seat block 12.

The spacing of the elongated slots 22 and the elongated locking rails 24 are specifically designed such that a pair of the rails 24 of one block will match with a pair of the elongated slots 22 of the seat block 12. To assemble the respective blocks 12, 14, 16 and 18 to form the chair shown in FIG. 2, it is appreciated that the respective elongated mating locking rails 24 will have to be vertically inserted into the elongated slots 22. Consequently, the arm blocks 14 and 16 are secured to the seat block 12 by simply elevating a respective arm block above the seat block 12 to where a pair of respective rails 24 associated therewith align with a pair of elongated slots 22. Then the arm blocks 14 or 16 are secured to the seat block 12 by simply sliding the arm block downwardly to where the bottom of the arm block rests flush against the underlying floor or support surface. The same approach applies for securing the back block 18 to the seat block 12. Again, the back block 18 is raised above the seat block 12 to where the elongated locking rails 24 align with a pair of elongated slots 22 formed on the back side of the seat block 12. Thereafter, the back block 18 is allowed to move downwardly such that the rails 24 move through and lock with the elongated slots 22 formed in the back side of the seat block 12. Consequently, in an assembled mode, the arm blocks 14 and 16 are secured to opposite sides of the seat block 12 while the back block 18 is secured to the back side of the seat block 12.

Because the arm blocks 14 and 16 and the back block 18 have elongated locking rails 24 on both sides thereof, it is appreciated that each of these blocks can be reversed and attached to the seat block 12 so as to expose additional letters of the alphabet.

The assembled chair shown in FIG. 2 can be readily disassembled by simply vertically moving the arm blocks 14 and 16 and the back block 18 with respect to the seat block 12. Essentially, to disassemble the respective blocks, the child slides the locking rails 24 from the elongated slots 22 and once the rails 24 have cleared the slots 22 it follows that the previously locked or secured blocks become uncoupled.

In an unattached mode, the respective blocks 12, 14, 16 and 18 can be used and played with individually. Thus, the child can view the blocks individually and in the process the blocks can be used as an educational tool to teach the letters of the alphabet to the child. In addition, the blocks in a separated mode can be played with and in that regard can be handled, manipulated, lifted, carried, and can even be stacked and used to build other basic block-type structures.

While the individual blocks of the present invention can be constructed of various materials, it is contemplated that in a preferred design the respective blocks 12, 14, 16 and 18 would be formed of a molded plastic which would be designed to impart strength but yet lightweight so that the blocks can be easily handled and manipulated by a child 3 to 6 years of age.

From the foregoing specification and discussion, it is appreciated that the alphabet block chair kit of the present invention presents a very dynamic and intriguing toy and educational tool for a child. Not only can the child learn the letters of the alphabet, but the child can also learn skills relating to building and connecting objects together to form a chair. In addition, the chair kit of the present invention is designed such that the chair can be easily assembled and disassembled and in the process at least some of the blocks can be reversed from time to time, thereby exposing different letters of the alphabet. It is appreciated that although the present invention shows a specific design that includes a certain number of blocks, that the alphabet block chair kit of the present invention can be designed in other specific ways and that the number of blocks utilized in the kit may vary.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. An alphabet block chair kit wherein the respective alphabet blocks comprising the kit can be assembled into a chair that can be readily disassembled, the alphabet block chair kit comprising:

a) a series of at least four alphabet blocks;

b) each block including a plurality of faces;

c) a single letter of the alphabet formed on respective faces of at least three of the blocks;

d) fasteners formed on certain of the faces of said blocks such that the blocks can be detachably secured together;

e) the fasteners including elongated slots formed in the certain faces of selected blocks and a series of mating elongated locking rails formed in the certain faces of other blocks; and f) wherein the elongated slots and mating locking rails are so arranged that the blocks can be assembled to form a chair where one block forms a seat portion of the chair, a pair of blocks connected to the seat block form side arms, and a fourth block secured to at least one of the other blocks forms the back of the chair.

2. The alphabet block chair kit of claim 1 further including a cushion having at least one side with a letter of the alphabet formed thereon.

3. The alphabet block chair kit of claim 1 wherein the elongated slots and the mating elongated locking rails are generally C-shaped and are designed such that the mating rails can be vertically directed into and through a selected elongated C-shaped slot to form a locked relationship between two respective blocks.

4. The alphabet block chair kit of claim 1 wherein at least one of the four blocks includes a relatively thin base section having opposed faces and an integral relatively thick upper section having opposed faces.

5. The alphabet block chair kit of claim 4 wherein the block having the base and upper sections forms the back of the assembled chair with the relatively thin base section being secured to one side of the designated seat portion block with the relatively thick upper section thereof extending upwardly from the seat portion block to form the back of the chair.

6. An alphabet block chair kit wherein respective alphabet blocks comprising the kit can be assembled into a chair and can be readily disassembled, comprising: a series of alphabet blocks with each block assuming a generally parallelepiped shape and including six distinct faces with each face having a substantial area; a single letter of the alphabet formed on respective faces of three of at least four of the generally parallelepiped alphabet blocks; fasteners formed on certain faces of said blocks such that the blocks can be detachably secured together; and wherein the fasteners are arranged and spaced with respect to each other such that the blocks comprising the kit may be arranged and secured together to form a chair structure and wherein in a secured mode, one of said alphabet blocks forms a seat of the chair while two other alphabet blocks form arms of the chair and the fourth alphabet block forms a back of the chair.

7. The alphabet block chair kit of claim 6 wherein the alphabet block chair kit consists of four alphabet blocks including the seat block, the two arm blocks, and the chair back block.

* * * * *